US007909904B2

(12) United States Patent
Allen

(10) Patent No.: US 7,909,904 B2
(45) Date of Patent: Mar. 22, 2011

(54) FACE FINISHED HONEYCOMB STRUCTURES AND METHODS OF MANUFACTURING SAME

(75) Inventor: Bruce Patrick Allen, Lawrenceville, PA (US)

(73) Assignee: Corning Incorporated, Corning, NY (US)

( * ) Notice: Subject to any disclaimer, the term of this patent is extended or adjusted under 35 U.S.C. 154(b) by 788 days.

(21) Appl. No.: 11/725,299

(22) Filed: Mar. 19, 2007

(65) Prior Publication Data

US 2008/0233345 A1 Sep. 25, 2008

(51) Int. Cl.

| | |
|---|---|
| ***B01D 39/00*** | (2006.01) |
| ***B01D 39/06*** | (2006.01) |
| ***B01D 39/14*** | (2006.01) |
| ***B01D 50/00*** | (2006.01) |
| ***F01N 3/00*** | (2006.01) |
| ***B01J 23/00*** | (2006.01) |

(52) U.S. Cl. ..... 55/523; 55/522; 422/169; 422/170; 422/171; 422/172; 422/177; 422/178; 422/179; 422/180; 422/181; 422/182; 60/297; 502/303

(58) Field of Classification Search ..... 55/522–524; 303/502; 60/297; 422/169–182; 502/303
See application file for complete search history.

(56) References Cited

U.S. PATENT DOCUMENTS

| | | | | |
|---|---|---|---|---|
| 4,557,773 | A | 12/1985 | Bonzo | 156/64 |
| 4,689,150 | A * | 8/1987 | Abe et al. | 210/490 |
| 5,487,694 | A | 1/1996 | Deming | 451/49 |
| 6,596,666 | B1 | 7/2003 | Yamada | 502/327 |
| 6,612,300 | B2 | 9/2003 | Mukota et al. | 125/20 |
| 6,776,689 | B2 | 8/2004 | Eichelberger | 451/8 |
| 7,083,842 | B2 | 8/2006 | Masukawa et al. | 428/116 |
| 2006/0105140 | A1 | 5/2006 | Andrewlavage, Jr. et al. | 428/131 |
| 2006/0131782 | A1 | 6/2006 | Mudd et al. | 264/259 |
| 2006/0217256 | A1 | 9/2006 | Katoh | 501/1 |
| 2006/0228519 | A1 | 10/2006 | Kato | 428/116 |
| 2008/0155952 | A1 * | 7/2008 | Okazaki et al. | 55/523 |

FOREIGN PATENT DOCUMENTS

| | | |
|---|---|---|
| JP | 2006-231475 | 9/2006 |
| JP | 2006-281039 | 10/2006 |
| JP | 2006281039 | * 10/2006 |
| WO | WO2006068256 | * 6/2006 |

OTHER PUBLICATIONS

Otsubo Yasuhiko, machine translation of JP2006281039, Oct. 2006.*

K. I. Jolic, et al., "Non-contact, optically based measurement of surface roughness of ceramics", Meas. Sci. Technol. 5(1994), pp. 571-684.

R. T. Blunt, "White Light Interferometry—a production worthy technique for measuring surface roughness on semiconductor wafers", CS Mantech Conference, Apr. 24-27, 2006, Vancouver, British Columbia, Canada, pp. 59-62.

* cited by examiner

*Primary Examiner* — Walter D Griffin
*Assistant Examiner* — Amber Orlando
(74) *Attorney, Agent, or Firm* — Matthew B. McNutt

(57) ABSTRACT

A method for producing a ceramic honeycomb structure comprises providing a honeycomb body having a side surface, a first cut end surface, a second cut end surface opposite the first end surface, and a maximum width (W), and removing material from at least one of the cut end surfaces of the honeycomb body to reduce the length (L), wherein the step of removing material comprises abrasively removing material from at least one of the ends with a rotating abrasive tool, such as by grinding, and wherein L/W is greater than 0.75. The method may achieve end flatness, parallelism, surface roughness and length accuracy, or combinations thereof which heretofore, were unachievable. Face finished ceramic honeycomb structures having low surface roughness (Ra), high degree of parallelism and accurate lengths are also disclosed.

11 Claims, 4 Drawing Sheets

FACE FINISHED HONEYCOMB STRUCTURES AND METHODS OF MANUFACTURING SAME

BACKGROUND OF THE INVENTION

1. Field of the Invention

This invention relates to methods of manufacture of ceramic honeycomb structures used as particulate filters, catalytic converters, and in particular, to a method for producing a ceramic honeycomb body that includes removing material from at least one of the ends of the honeycomb body with a rotating abrasive tool, thereby providing an end surface with surface characteristics heretofore unachievable.

2. Description of the Related Art

Ceramic honeycomb structures having traverse cross-sectional cellular densities of approximately 1/10 to 100 cells or more per square centimeter have several uses, including solid particulate filter bodies and catalytic converter substrates. In certain uses, such as in particulate filters, the configuration may require selected cells of the porous ceramic honeycomb structure to be sealed or plugged, such as at one or both of the respective ends thereof. These uses generally require the production of these honeycomb structures to exacting length dimensions. The manufacture of these honeycomb structures from plasticized powder batches comprising inorganic powders dispersed in appropriate binders is well known. U.S. Pat. Nos. 3,790,654; 3,885,977; and 3,905,743 describe extrusion dies, processes, and compositions for such manufacture, while U.S. Pat. Nos. 4,992,233 and 5,011,529 describe honeycomb structures of similar cellular structure extruded from batches incorporating other powders.

As an example, reference numeral 9 (FIG. 1) generally designates a prior art, honeycomb structural body that is generally well known. The body includes a honeycomb structure 12 formed by a matrix of intersecting, relatively thin, porous walls 14 surrounded by an outer wall 15 (otherwise referred to as a skin), which, in the illustrated example, is provided in a circular cross-sectional configuration having a maximum width dimension (W). The walls 14 extend across and between a first end 13 that includes a first end face 18, and a second end 17 that includes an opposing second end face 20, and form a large number of adjoining hollow passages or cell channels 22 which also extend between and are open at the end faces 18, 20 of the filter body 10.

To form the filter 10 (FIGS. 2 and 3), some of the cells 22 are sealed, for example at one end of at least some of the cells. In one example, a first subset 24 of the cells 22 are sealed at the first end face 18, and a second subset 26 of the cells are sealed at the second end face 20. Either of the end faces 18, 20 may be utilized as the inlet face of the resulting filter 10. In a typical cell structure, each inlet cell channel may be bordered on one or more sides by outlet cell channels and vice versa. Each cell channel 22 may have a square cross section or may have other cell geometry, e.g., circular, rectangular, triangular, hexagonal, octagonal, etc. Diesel particular filters are typically made of ceramic materials, such as cordierite, aluminum titinate, mullite, or silicon carbide, and generally include total porosities of between about 40% and 70%.

In operation, contaminated fluid is brought under pressure to an inlet face (either of the end faces 18, 20) and enters the filter 10 via cell channels 22 which have an open end at the given inlet face. Because these cell channels 22, in a typical configuration, may be sealed at the opposite end face, i.e., the outlet face of the body, the contaminated fluid is forced through thin porous walls 14 into adjoining cell channels 22 which are sealed at the inlet face and open at the outlet face.

The solid particulate contaminate in the fluid, which is too large to pass through the porous openings in the walls 14, is left behind and a cleansed fluid exits the filter 10 through the outlet cell channels 22.

For the mass production of such filters and substrates, it is highly desirable to be able to rapidly and accurately provide honeycomb structures having desirable end surfaces through a robust and repeatable process. In particular, it is desired to achieve this on filters and substrates having high aspect ratios.

SUMMARY OF THE INVENTION

According to a first aspect, the present invention is a method for producing a ceramic honeycomb body which comprises the steps of providing a honeycomb body having a first cut end face, a second cut end face opposite the first cut end face, and a maximum width (W), and removing material from the first cut end face to reduce a length (L) of the honeycomb body, wherein the step of removing material comprises abrasively removing material from the first cut end face with a rotating abrasive tool wherein after the step of removing material, the honeycomb body exhibits a L/W ratio of greater than 0.75. The honeycomb body includes a planar surface substantially across an entire end face thereof.

The honeycomb bodies may be selected from the group of honeycomb filters and honeycomb catalyst substrates. The honeycomb bodies may further exhibit an aspect ratio defined as the length (L) divided by a widest width dimension W (generally a diameter), L/W which is greater than 1.00, or even greater than 1.25.

In another aspect, the present invention is a method for manufacturing a ceramic honeycomb body, comprising the steps of providing a honeycomb body having a side face, a first cut end face, a second cut end face opposite the first cut end face, and a maximum width (W); removing material from the first end face of the honeycomb body; and removing material from the second end face of the honeycomb body, wherein the steps of removing material result in a length (L) having a standard deviation of less than or equal to 0.35 mm from a target length wherein after the step of removing material, the honeycomb body exhibits a L/W ratio of greater than 0.75.

According to another aspect of the present invention, a method for manufacturing a ceramic honeycomb body is provided, comprising the steps of providing a honeycomb body having a side surface, a first end face, a second cut end face opposite the first cut end face, and a maximum width (W); removing material from the first cut end face of the honeycomb body; and removing material from the second cut end face of the honeycomb body to produce a length (L), wherein the steps of removing material from the first and second cut end faces of the honeycomb body result in a parallelism between resulting ground end faces of the honeycomb body of less than or equal to 0.4 mm, and after the steps of removing material, the honeycomb body exhibits a L/W ratio of greater than 0.75.

Yet another aspect of the present inventive method for manufacturing a ceramic honeycomb filter comprises providing a green body honeycomb having a first end face, and a second end face, and a plurality of channels extending along the length between the first and second end faces, firing the honeycomb body to produce a fired honeycomb, grinding material from at least one of the first end face and the second end face of the fired honeycomb body to reduce the length of the fired honeycomb body and to produce a fired and ground honeycomb body, and plugging at least some of the plurality of channels of the fired and ground honeycomb body. End grinding may significantly reduce unwanted plugs.

Still yet another aspect of the present inventive method for manufacturing a ceramic honeycomb filter comprises providing a green honeycomb body having a first end face, a second end face, and a plurality of channels extending along the length between the first and second end faces, grinding material from at least one of the first end face and the second end face of the green honeycomb body to reduce the length thereof, plugging at least some of the plurality of channels of the green honeycomb body subsequent to the grinding step and to form a plugged green honeycomb body, and firing the plugged green honeycomb body to produce a ceramic honeycomb filter.

The present inventive method for manufacturing a ceramic honeycomb filter is robust, highly repeatable and cost effective, and produces ceramic honeycomb structures, such as filters, having precision end surfaces exhibiting desirable features. For example, relatively low end face surface roughness (of the end of the cell wall), relatively high degree of parallelism, and accurate length (L) as compared to a target length, or any combinations thereof may be achieved by the present inventive method. In particular, such methods are applicable for manufacturing high aspect ratio honeycomb structures having a length (L) divided by maximum width (W) of greater than 0.75, greater than 1.00, or even greater than 1.25. Such methods are particularly useful for producing planar end faces across a substantial end portion of such honeycomb structures.

According to yet another broad aspect of the invention, a ceramic honeycomb structure is provided, comprising a honeycomb body having a side surface, a first end face, a second end face opposite the first end face, and a maximum width (W), and a length (L) defined between the first end face and the second end face wherein at least one of the first and second end faces exhibits a ground end surface having a surface roughness Ra of less than 5.0 μm and the honeycomb body exhibits a L/W ratio of greater than 0.75. Additional embodiments exhibit Ra less than or equal to 4.8 μm; or even Ra less than or equal to 3.9 μm.

According to another broad aspect of the invention, a ceramic honeycomb structure is provided, comprising a honeycomb body having a first end face, a second end face opposite the first end face, a length (L) between the first and second end faces, and a maximum width (W), wherein at least one of the first and second end faces exhibits a ground end surface having a bearing ratio of greater than or equal to 25% and the honeycomb body exhibits a L/W ratio of greater than 0.75. In some embodiments, the bearing ratio may be greater than or equal to 35%. High bearing ratios help produce fewer unwanted plugs in filter plugging processes.

In accordance with another broad aspect of the invention, a ceramic honeycomb structure is provided, comprising a honeycomb body having a side surface, a first end face, a second end face opposite the first end face, a maximum width (W), and a length (L) wherein the first and second end faces are ground end surfaces across an entire surface thereof and exhibit parallelism between the respective ground end surfaces of less than or equal to 0.4 mm and the honeycomb body exhibits a L/W ratio of greater than 0.75. Additional embodiments exhibit parallelism of less than or equal to 0.3 mm; or even less than or equal to 0.25 mm.

These and other advantages, features and aspects of the invention will be further understood and appreciated by those skilled in the art by reference to the following written specification, claims, and appended drawings.

DETAILED DESCRIPTION OF THE EMBODIMENTS OF THE INVENTION

Figure 1:
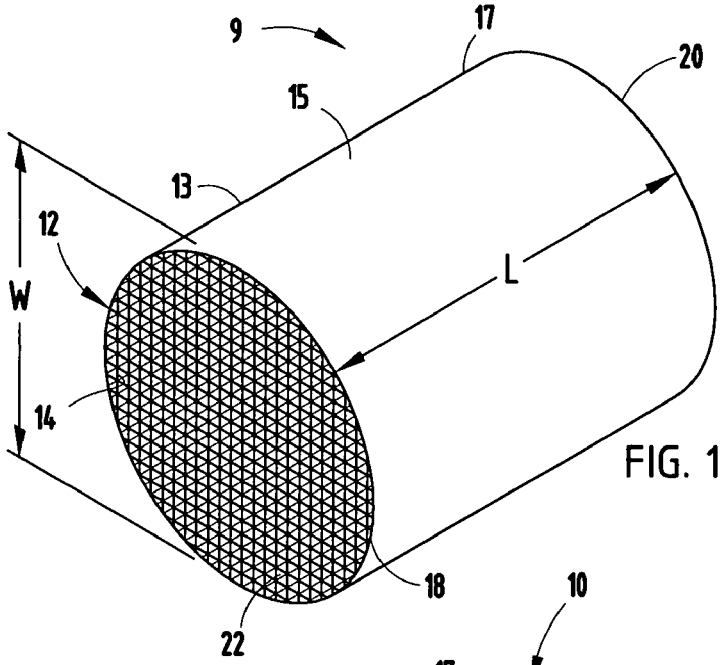
FIG. 1 is a perspective view of a honeycomb body including a first end having a plurality of open-ended cell channels.
Figure 2:
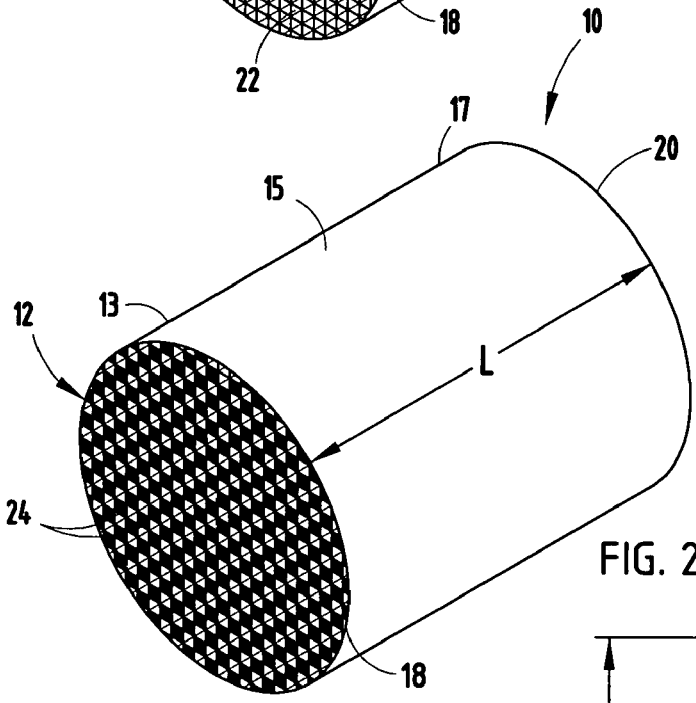
FIG. 2 is a perspective view of a filter body, wherein a first subset of the cell channels are plugged, and a second subset of the channels are open-ended.
Figure 3:
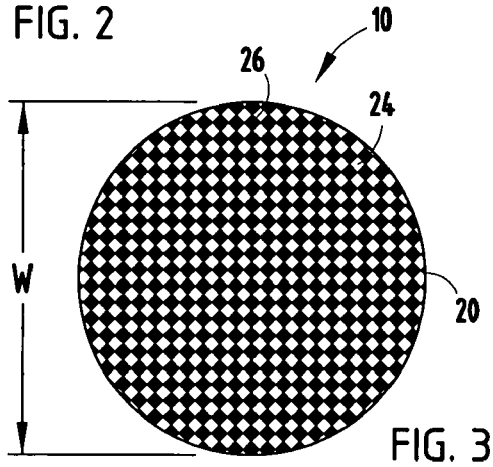
FIG. 3 is an end view of the filter body including a second end, wherein the first subset of the cell channels are open-ended and a second subset of the cell channels are plugged.
Figure 5:
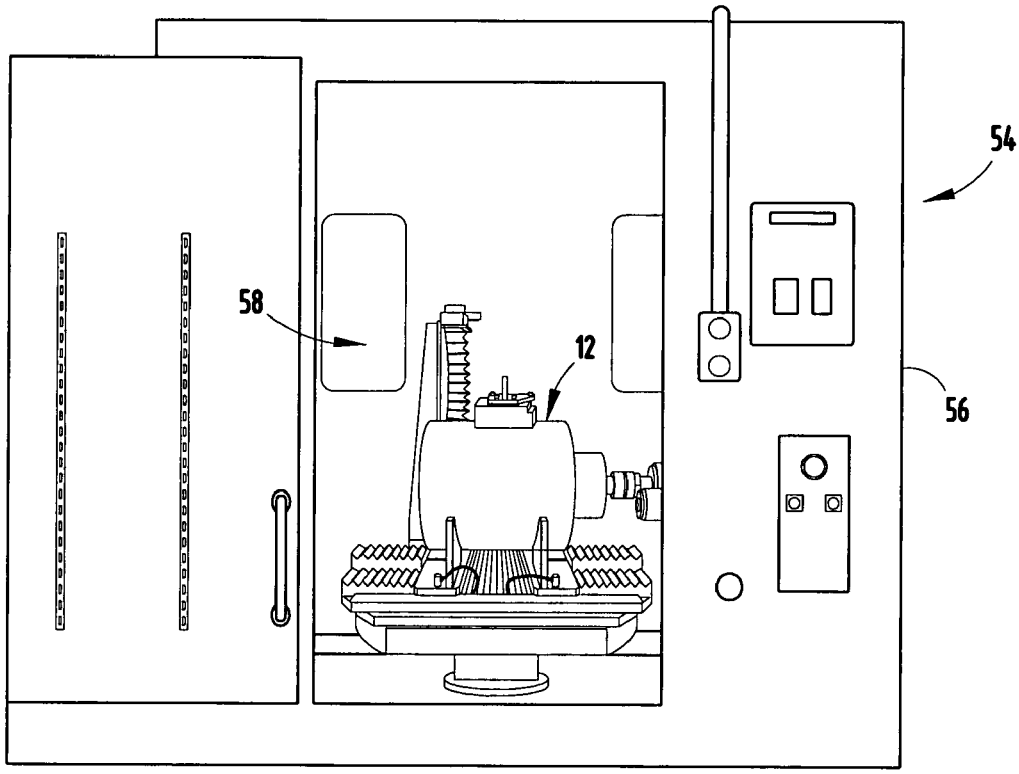
FIG. 5 is a front elevation view of a CNC machine utilized in employing the present invention.

For purposes of description herein, the terms "upper," "lower," "right," "left," "rear," "front," "vertical," "horizontal," and derivatives thereof shall relate to the invention as oriented in FIGS. 1 and 5. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
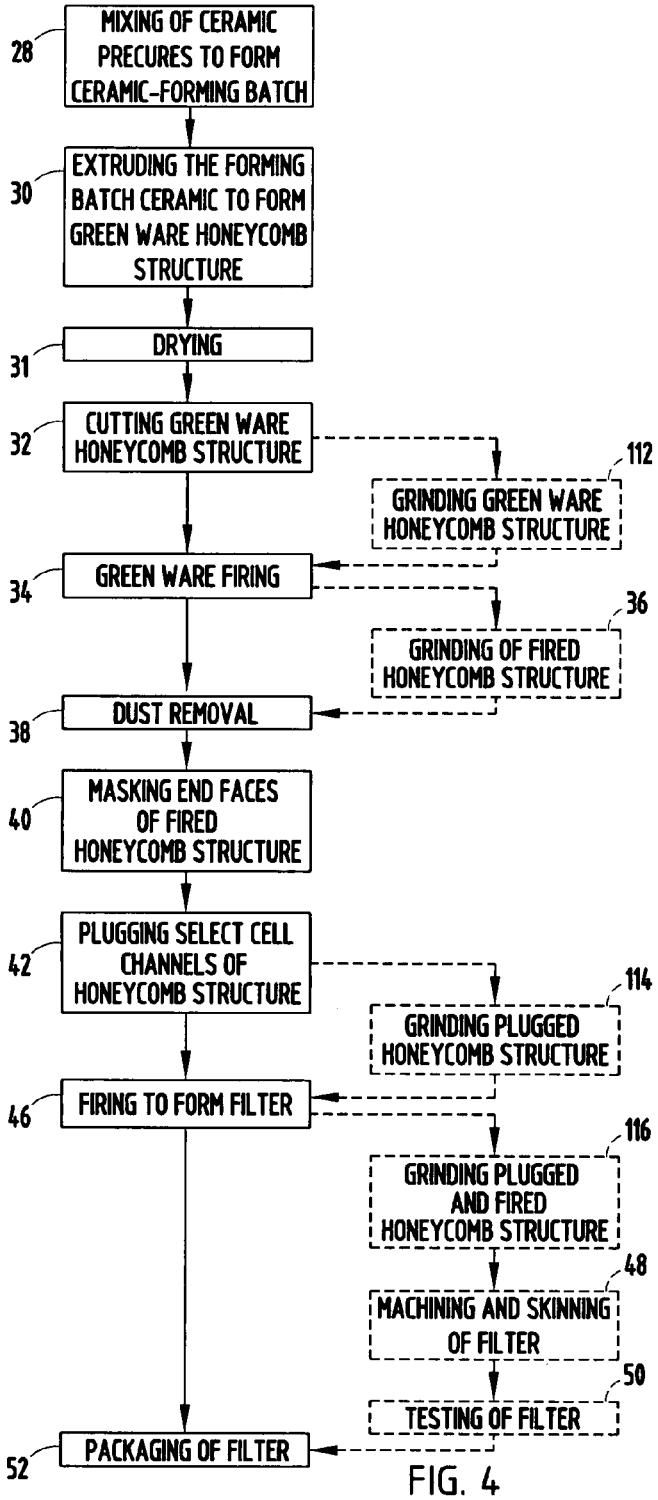
FIG. 4 is a flow chart of the present inventive process for manufacturing a ceramic honeycomb filter including alternative embodiments of the present invention (shown in dashed lines).
Figure 9:
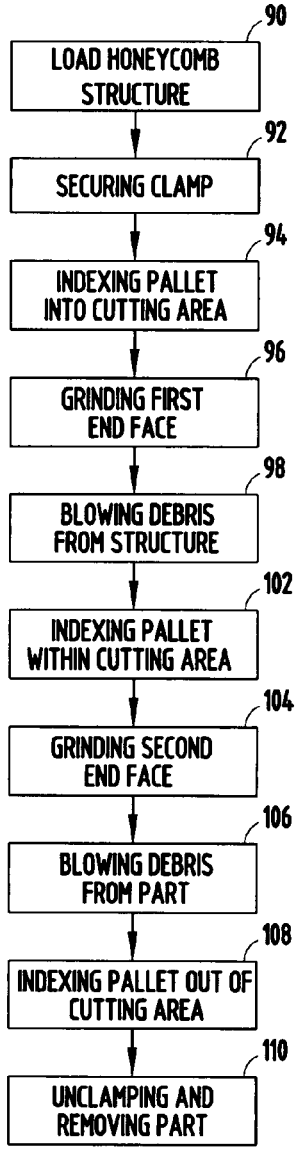
FIG. 9 is a flow chart of a grinding procedure of the present inventive process.

The present inventive method for manufacturing the honeycomb structure 12 described above, in one embodiment, is generally outlined in the flow charts of FIGS. 4 and 9, and may include, during a formation sequence, the steps of batch mixing 28 of a preferably aqueous-based ceramic precursor components to form a ceramic-forming plasticized batch used to form the walls 14, 15 of the honeycomb structures 12, extruding 30 the plasticized batch through an extrusion die thereby forming a greenware honeycomb structure, and drying the greenware honeycomb structure 31. Next, in a step of cutting 32, the greenware honeycomb structure is cut to a particular length, each end exhibiting a cut end face. The method also includes a step of firing 34 of the greenware honeycomb structure to form a fired porous ceramic honeycomb structure. In accordance with a first embodiment of the invention, a step of grinding 36 is performed on the cut end face (or faces) of the fired honeycomb structure to provide one or more ground and finished end faces. Heretofore, the honeycomb filter and substrate structures were cut to a particular length by use of a diamond-tipped saw, the effects of which have resulted in relatively rough surfaces. This rough surface condition has presented difficulties when attempting to manufacture honeycomb filter structures, and particularly when attempting to plug the channels of the honeycomb structures to form the filters. For example, high levels of unwanted plugs were encountered in cell channels not desired to be plugged when the end face surface roughness is too large. The method may further include removing the dust 38 created during the grinding process 36, masking 40 the end faces of the fired honeycomb structure, such as by adhering an adhesive backed polymer film and cutting holes at the locations of cells to be plugged (such as by a laser), plugging 42 selected cell channels 22 of the fired honeycomb structure, and calcining 46 of the plugged honeycomb structure to form a fired filter. In some cases, additional steps of machining and skinning 48 the filter may be employed. The method may further include testing 50 the filter and packaging 52 the same for shipment. Alternative methods wherein the grinding step is employed at various times during the overall manufacturing process are described below, such as after plugging the filter.

Figure 6:
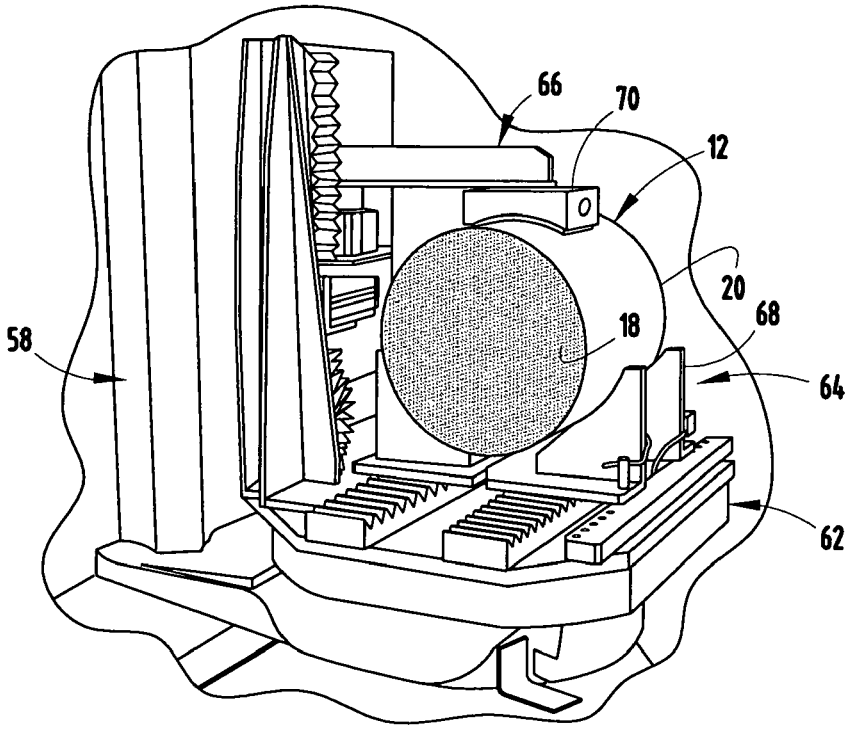
FIG. 6 is an enlarged perspective view of an indexing fixture of the CNC machine, wherein the fixture is located in a load/unload position.
Figure 7:
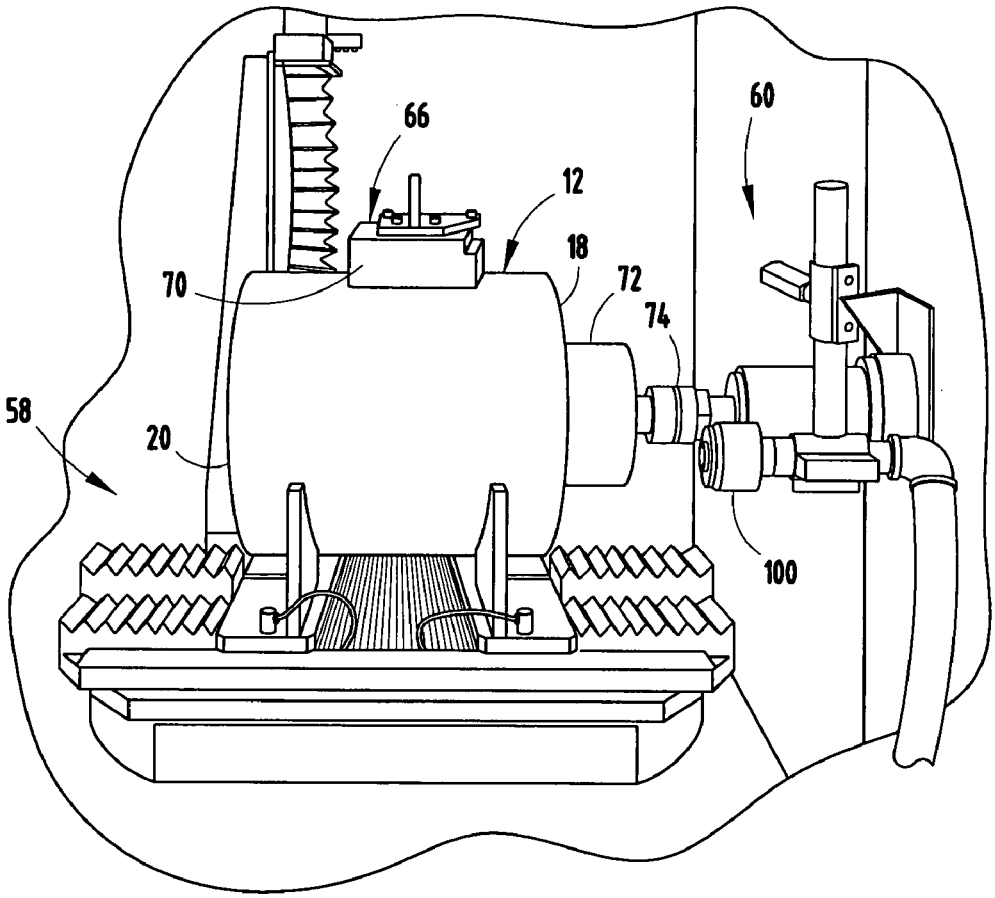
FIG. 7 is an enlarged perspective view of the indexing fixture and a grinding assembly of the CNC machine, wherein the fixture is located in a grinding position.

In the illustrated example, the step of face grinding 36 of the fired honeycomb structure is accomplished via a computer numerical controlled or CNC milling machine 54 (FIG. 5). The CNC machine 54 generally includes a housing 56 enclosing an indexing fixture 58 (FIG. 6) and a grinding assembly 60 (FIG. 7) mounted therein. The indexing fixture 58 includes a pallet 62, and a holder made up of a V-shaped chuck 64 mounted on the pallet, and a clamping assembly 66 to hold the structure 12 into the V-shaped chuck. The pallet 62 may be indexed and rotated between a loading position, as best illustrated in FIG. 6, and a grinding position, as best illustrated in FIG. 7. The indexing fixture 58 specifically allows for each end face 18, 20 of the honeycomb structure 12 to be indexed into the cutting area of the CNC machine 54 to allow sequential end face grinding without having to reposition the structure 12 in the holder. Thus, both ends of the structure may be quickly and precisely machined to close tolerances. The chuck 64 includes a pair of opposing supports that are adjustably positioned so as to support the honeycomb structure 12 thereon. The vertically-adjustable clamping assembly 66 includes a clamping member 70 that abuts the outer wall 15 of the honeycomb structure 12 and securely holds the structure in contact with the support 68 and within the indexing fixture 58.

Figure 8:
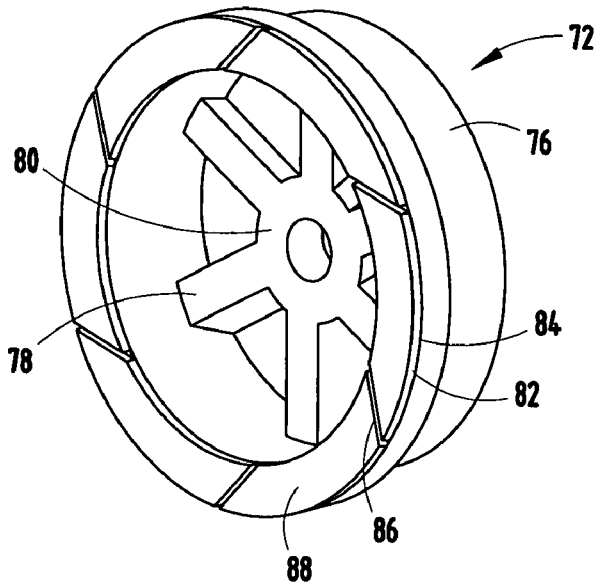
FIG. 8 is an enlarged perspective view of a grinding tool of the grinding assembly.

The grinding assembly 60 includes a grinding tool 72 driven in rotation by a power shaft 74 which is, in turn, mechanically coupled with a drive shaft system (not shown). The grinding tool 72 (FIG. 8) of the present example comprises a cup wheel grinding tool and includes a cylindrical body portion 76 that is coupled to the power shaft 74 via a plurality of spokes 78 and a central hub 80. The grinding element 88 is fixed to an end surface 84 of the cylindrical body portion 76 and comprises a generally annular ring of resin- or metal-bonded diamond having a planar surface formed thereon. The grinding element 88 may include a plurality of slots 86 formed therein. The slots 86 form a plurality of accurately-shaped grinding elements 82. The grinding elements 82 provide a plurality of grinding surfaces and the slots efficiently carry away the ground material. It is noted that while a particular configuration of the grinding tools 72 is described herein, other configurations suitable for the desired purposes may also be utilized. A 50-160 diamond grit size, natural or synthetic diamond type, and 50 and 125 diamond concentration and a resin bond was found to work well.

The step of grinding the fired honeycomb structure 36 includes loading 90 (FIG. 9) the honeycomb structure 12 to be ground into the indexing fixture 58, and specifically loading the honeycomb structure 12 within the clamping assembly 66 and securing 92 the clamping assembly 66 such that the honeycomb structure 12 is secured within the indexing fixture 58. This indexing configuration allows the machining of extremely precise and parallel planar surfaces on multiple ends of such honeycomb structures which have high aspect (L/W) ratios. For example, porous ceramic honeycomb structures having high aspect ratios, defined as the length (L) divided by maximum width dimensions (W) (generally a diameter), such as greater than 0.75, may be readily accommodated and ground (such as honeycomb filters and honeycomb catalyst substrates). The honeycomb structures may further exhibit, for example, an aspect ratio defined as the length (L) divided by a widest width dimension W which is greater than 1.00, or even greater than 1.25. Such precise surface conditions, lengths, and parallelism may be produced even at such high aspect ratios.

The grinding process further includes indexing 94 the pallet 62 into the cutting area of the CNC machine 54, and grinding 96 the first end face 18 of the structure 12 with the grinding tool 72. It is noted that the grinding tool 72 may be passed across the first end 18 of the honeycomb structure 12 via a plurality of patterns, including, but not limited to, single or multiple passes, reversing patterns, and circular or linear paths. During the step of grinding the previously cut end face, the rotating grinding tool 72 is brought into contact with the cut end face. By way of example, the tool may have a diameter of about 6 to 16 inches and is rotated at about 1000 to 6000 rpm. Each pass of the tool removes about ⅛ inch maximum. Thus, it should be understood that the honeycomb is first cut to a dimension just above the target length of the honeycomb, and then the honeycomb article is ground to the target length. The grinding step 96 of the first cut end face 18, given only a small amount of material is removed, produces dust which may be removed by blowing 98 in a stream of gas, such as air, through the plurality of channels 22 extending between the first and second faces 18, 20, for example, via an nozzle 100 mounted and located proximate the grinding assembly 60.

Following grinding the first end face, the honeycomb structure 12 is indexed within the cutting area about an axis parallel (such as a vertical axis) with the first ground end face such that the orientation of the structure 12 to the grinding assembly 60 is reversed. This brings the second cut end face 20 into the proximity of the grinding tool 72. The process then includes grinding 104 the second cut end face 20, and may further include blowing or removing 106 the dust debris from the channels 22 created during the grinding step 104 in a manner similar to the grinding step 96 and the blowing step 98, respectively. Again, only a small amount of material is removed during this grinding step. The pallet 62 is then indexed from the cutting area of the CNC machine 54 to the loading and unloading area where the milled honeycomb structure 12 is unclamped and removed 110 from within the indexing fixture 58. The structure 12 is now ground to the desired target length.

Although the above-described process includes grinding 36 of a fired honeycomb structure subsequent to firing of a greenware structure, the present inventive grinding method may also be utilized to grind the cut end faces 18, 20 of the honeycomb structure 12 at various times within the manufacturing process thereof. As an example, the grinding process may be utilized to grind the cut end face of a greenware honeycomb structure, and/or the end face of a fired and plugged honeycomb structure thereby grinding both the ends of the walls of the end face and the ends of the plugs simultaneously. Additionally, the grinding process may be used to simultaneously grind the fired end face and fired (or calcined)

end plug. Specifically, the present inventive process may include any one of a number of grinding steps within the overall manufacturing process, including grinding 112 (FIG. 4) of a greenware honeycomb structure, the grinding 36 of the fired honeycomb structure, the grinding 114 of a fired and plugged honeycomb structure, and the grinding 116 of a fired plug honeycomb structure.

The present inventive process results in improved physical characteristics of each of the ground end faces 18, 20 of the filter 10, and specifically provides ground end faces 18, 20 having improved parallelism, surface roughness, as well as more accurate length (L) as compared to a target length. The present inventive method is particularly useful for finishing the end faces of honeycomb filters and substrates having L/W ratios of greater than 0.75, greater than 1.00, or even greater than 1.25. In terms of finishing filters to a precise length, a standard deviation of the overall length (L) of the resultant filter 10, as measured between the first end face 18 and the second end face 20, after grinding of both cut end faces is preferably less than or equal to 0.35 mm, or even less than or equal to 0.175 mm, relative to a target length. The length (L) is measured by either a non-contact laser gauge or standard contact measuring device such as a dial indicator while the ground structure is resting on a surface plate. A suitable number of measurements are taken across the face to determine the length variability and the standard deviation from the target length. In accordance with another broad aspect, the present inventive method may result in honeycomb filters having a parallelism of the first end face 18 with respect to the second end face 20 of less than or equal to 0.4 mm; less than or equal to 0.3 mm; or even less than or equal to 0.25 mm. Parallelism is measured and defined herein as the peak difference between the maximum and minimum height (length) readings, as measured by resting the structure 12 on an end face on a flat test surface.

Additionally, the abrasive machining operation may provide a smooth surface on the end face of the structure 12. In particular, the method may provide a surface roughness Ra of the machined surface of the end face of preferably less than or equal to 5.0 μm, less than or equal to 4.9 μm, or even less than or equal to 3.9 μm. The surface roughness Ra, as noted above, is defined as an arithmetic average roughness measured on a Zyglo New View 5000, white light interferometer, in a predetermined direction on the ground end face surface according to ISO4287/1, and is calculated as an average value of absolute deviations of the concave/convex surface portions from an average line. The scan is based on a bipolar measurement control setting, scan length of 150 μm, image zoom of 40×, and the high and low filter frequencies on the analyze control filters set on 10 μm and 100 μm, respectively.

Providing a smooth surface on the end face of the honeycomb dramatically improves the plugging operation by improving the surface's bearing ratio, as well as removing end wall chips and defects that deter proper masking. Masking involves adhering an adhesively-backed polymeric film onto the ground end, then burning holes (such as with a laser) into the mask at locations corresponding with the cells to be plugged, and then transferring plugging cement into the respective cells to be plugged. Plugging cement is transferred into the cell channels through the holes in the plug masks. Plugging and masking methods and apparatus which may be used for masking and plugging filters in accordance with aspects of the invention are disclosed in US 2006/0131782 entitled "Plugging Methods And Apparatus For Particulate Filters" and U.S. Pat. No. 4,557,773 entitled "Method For Selectively Manifolding Honeycomb Structures" and WO2006/055402 entitled "Mask For Plugging Particulate Filter Cells."

In accordance with another aspect, the machining operation of the present inventive method further provides a honeycomb structure having a ground end surface with a bearing ratio of preferably greater than or equal to 25%, and more preferably greater than or equal to 35%, wherein the bearing ratio is defined as the percentage of available surface area of a given end face of the honeycomb structure that contacts a flat surface subsequent to the grinding of the subject end face. This is a direct measure of the amount of flat seal area available for the subsequent masking operation. Higher bearing area percentages connote significantly flatter surfaces, which may increase mask adherence when using adhesively-backed plugging mask and thereby result on lesser numbers of unwanted (errant) plugs. The bearing ratio is also measured by the white light interferometer listed above and uses the same machine settings. Of course, when masks are used that are not adhered to the ground end face of the honeycomb structure, improved plugging may be achieved because of the improved registry of the mask and the removal of end chips.

Heretofore, the honeycomb catalyst and filter structures were cut to a particular length by use of a diamond-tipped saw, the effects of which have resulted in relatively rough cut end surfaces, poor parallelism and length control. As described above, this has presented difficulties when attempting to manufacture the honeycomb structure, and particularly when attempting to plug the cell channels of the structure with plugging cement. These difficulties have been overcome by the present invention.

In the foregoing description, it will be readily appreciated by those skilled in the art, that modifications may be made to the invention without departing from the concepts as disclosed herein, such modifications are to be considered as included in the following claims, unless these claims by their language expressly state otherwise.

What is claimed is:

1. A ceramic honeycomb structure, comprising:

a honeycomb body having a side surface, a first end face, a second end face opposite the first end face, and a maximum width (W), and a length (L) defined between the first end face and the second end face wherein at least one of the first and second end faces exhibits a ground end surface having a surface roughness Ra of less than 5.0 μm and the honeycomb body exhibits a L/W ratio of greater than 0.75.

2. The ceramic honeycomb structure of claim 1 wherein the ground end surface further comprises surface roughness Ra less than or equal to 4.8 μm.

3. The ceramic honeycomb structure of claim 1 wherein the ground end surface further comprises surface roughness Ra less than or equal to 3.9 μm.

4. The ceramic honeycomb structure of claim 1 wherein the ground end surface exhibits a bearing ratio of greater than or equal to 25%.

5. The ceramic honeycomb structure of claim 4 wherein the bearing ratio of the ground end surface is greater than or equal to 35%.

6. The ceramic honeycomb structure of claim 1 wherein both of the first and second end faces exhibit a ground end surface and the length (L) has a standard deviation of less than or equal to 0.35 mm from a target length.

7. The ceramic honeycomb structure of claim 6 wherein the standard deviation is less than or equal to 0.175 mm from the target length.

8. The ceramic honeycomb structure of claim 1 wherein both of the first and second cut end faces exhibit a ground end surface and parallelism between the respective ground end surfaces of the honeycomb body is less than or equal to 0.40 mm.

9. The ceramic honeycomb structure of claim 8 wherein the parallelism is less than or equal to 0.30 mm.

10. The ceramic honeycomb structure of claim 8 wherein the parallelism is less than or equal to 0.25 mm.

11. A ceramic honeycomb structure, comprising:

a honeycomb body having a first end face, a second end face opposite the first end face, a length (L) between the first and second end faces, and a maximum width (W), wherein at least one of the first and second end faces exhibits a ground end surface having a bearing ratio of greater than or equal to 25% and the honeycomb body exhibits a L/W ratio of greater than 0.75.

* * * * *